US007060015B2

(12) United States Patent
Acher

(10) Patent No.: US 7,060,015 B2
(45) Date of Patent: Jun. 13, 2006

(54) EXERCISE DEVICE

(76) Inventor: Raider R. Acher, 707 N. Genesse, Apt. 1, Los Angeles, CA (US) 90046

( * ) Notice: Subject to any disclaimer, the term of this patent is extended or adjusted under 35 U.S.C. 154(b) by 0 days.

(21) Appl. No.: 10/443,325

(22) Filed: May 22, 2003

(65) Prior Publication Data

US 2004/0235626 A1 Nov. 25, 2004

(51) Int. Cl.
*A63B 26/00* (2006.01)

(52) U.S. Cl. ..... 482/142; 482/140

(58) Field of Classification Search ..... 482/121–130, 482/907, 91, 140, 142, 148, 79–80, 34; D21/671, D21/676, 686–687
See application file for complete search history.

(56) References Cited

U.S. PATENT DOCUMENTS

| | | | | |
|---|---|---|---|---|
| 5,833,587 | A * | 11/1998 | Strong et al. | 482/123 |
| 6,375,601 | B1 * | 4/2002 | Johnson | 482/142 |
| 6,425,842 | B1 * | 7/2002 | Stern et al. | 482/35 |
| 6,689,026 | B1 * | 2/2004 | Almada | 482/140 |
| 6,702,726 | B1 * | 3/2004 | Lin | 482/148 |

OTHER PUBLICATIONS

Paul Chek, Big Bench—Bad Shoulders, 4 pages, internet website www.chekinstitute.com.
MegaFitness.com, Paul Chek Duraball Pro—55 cm—21", 1 page, internet website: www.megafitness.com.
Sissel-Shop-USA, Swiss Ball Pro 22"/55-cm, 2 pages, internet website: www.sissel-shop-usa.com.
Sissel-Shop-USA, The Sissel Stabilizer, 1 page, internet website: www.sissel-shop-usa.com.
Sissel-Online.com, Sissel-Online.com, 1 page, internet website: www.sissel-online.com.
Sissel-Online.com, Contact Info, 1 page, internet website: www.sissel-online.com.
Gym Ball Store, StopperBall, 2 pages, internet website: http://gymball.com/StopperBall.html.
nefitco.com, Trust Gymnic quality—the World's #1 selling exercise ball, 3 pages, internet website.
Ball Dynamics International, Ledraplastic, 1 page, internet website: www.balldynamics.com.

* cited by examiner

*Primary Examiner*—Lori Amerson
(74) *Attorney, Agent, or Firm*—Milord A. Keshishian

(57) ABSTRACT

An exercise or therapy device to be used in conjunction with an exercise ball having a first region for securely, yet removably, receiving the ball and a second region for positioning a user's body parts thereon for stability while a separate body part is resting on the ball.

9 Claims, 3 Drawing Sheets

EXERCISE DEVICE

FIELD OF THE INVENTION

This invention relates to the exercise and physical fitness industry and, in particular, the invention relates to an exercise device having a stabilizing base for receiving and maintaining a resilient ball member therein for use in physical training, therapy, and weight lifting.

BACKGROUND OF THE INVENTION

The prior art teaches using various resilient exercise balls in physical therapy and exercise. The exercise balls are sometimes referred to as "therapy balls" or "Swiss balls" and are available from numerous vendors and in varying sizes. The basic exercise ball is a flexible, inflatable or foam filled ball of rubber or plastic and is available in various diameters. Generally, the exercise balls are used on the floor surface without a stabilizing component; however, if the individual using the same is not coordinated or is engaged in vigorous exercise, the ball may easily be displaced. Ring like members have been used to engage the exercise ball to stabilize the same. However, the shortness of the ring's wall fails to provide stable support during vigorous exercise resulting in a loss of balance and limits the exercise positions that may be assumed by the user.

U.S. Pat. No. 6,375,601 teaches an exercise apparatus that maintains an exercise ball in a position above the floor or support surface. In one embodiment of the '601 apparatus, two pairs of opposing legs are interconnected by cross members and a receptacle is created between the cross members by extending a flexible fabric material therebetween. The receptacle is adapted to receive one or more exercise balls and supports the balls in a stable, elevated position above the floor surface. In an alternate embodiment, the '601 apparatus has a unitary body with end walls interconnected by side walls which define a seat member above the base. However, the seat member is not adapted to receive an exercise ball thereon. In addition, the flexible material extending between the cross members may not provide the requisite stability for the exercise ball maintained thereon. Furthermore, the cost of manufacturing the apparatus as a result of its metal components may be increased.

U.S. Pat. No. 5,833,587 discloses an exercise apparatus having a concave base which receives an exercise ball therein and at least one attachment point on the base to allow attachment of elastic bands thereto. The base allows a user to be seated substantially directly on top of the exercise ball, but does not provide enough stability to allow a user to switch to alternate body positions without dislodging the exercise ball. Furthermore, the plastic base bears the weight of the user and free-weights which are being used thereby increasing the susceptibility of the base to structural failure.

The prior art does not address the need for an exercise device that provides sufficient stability and structural integrity to support the weight of a user and additional weights used in exercise. In addition, the prior art fails to provide an exercise device to be used with a therapy ball that maintains the ball in a stable state and provides additional exercise options and positions. Therefore, there remains a long standing and continuing need for an advance in the art of exercise devices that is simpler in both design and use, is more economical, efficient in its construction and use, and eliminates the need for complex structures that may be susceptible to failure.

SUMMARY OF THE INVENTION

Accordingly, it is a general object of the present invention to overcome the disadvantages of the prior art.

In particular, it is an object of the present invention to provide an exercise device that provides stable support for a therapy ball.

It is another object of the present invention to provide an exercise device featuring ease of use.

It is another object of the present invention to provide an exercise device that permits comfortable accommodation for various body parts for a broad array of exercises.

It is another object of the present invention to provide an exercise device that is economical in cost to manufacture and use.

It is another object of the present invention to provide an exercise device that provides support for the back or stomach while performing hyper-extension type exercises.

It is yet a further object of the present invention to provide an exercise device that is portable and provides ease of transportation for personal trainers that visit clients at different locations.

In keeping with the principles of the present invention, a unique exercise device is disclosed having a first region that is substantially semi-spherically shaped to accommodate the exercise ball therein in a stable yet removable manner. The bottom of the semi-spherically shaped region has an aperture of sufficient size to allow the ball to contact the floor's surface therethrough and to transfer a portion of the force applied to the ball to the floor. The device also has a second region that allows a user to sit or kneel thereon and further provides a second area for the user's feet when engaging in weight resistant or stretching exercises.

The device also provides a member that is adapted to allow the user to lay or sit thereon such that the muscles that are being exercised can be addressed at different angles.

Such stated objects and advantages of the invention are only examples and should not be construed as limiting the present invention. These and other objects, features, aspects, and advantages of the invention herein will become more apparent from the following detailed description of the embodiments of the invention when taken in conjunction with the accompanying drawings and the claims that follow.

BRIEF DESCRIPTION OF THE DRAWINGS

It is to be understood that the drawings are to be used for the purposes of illustration only and not as a definition of the limits of the invention.

In the drawings, wherein similar reference characters denote similar elements throughout the several views.

DETAILED DESCRIPTION OF THE INVENTION

Figure 1:
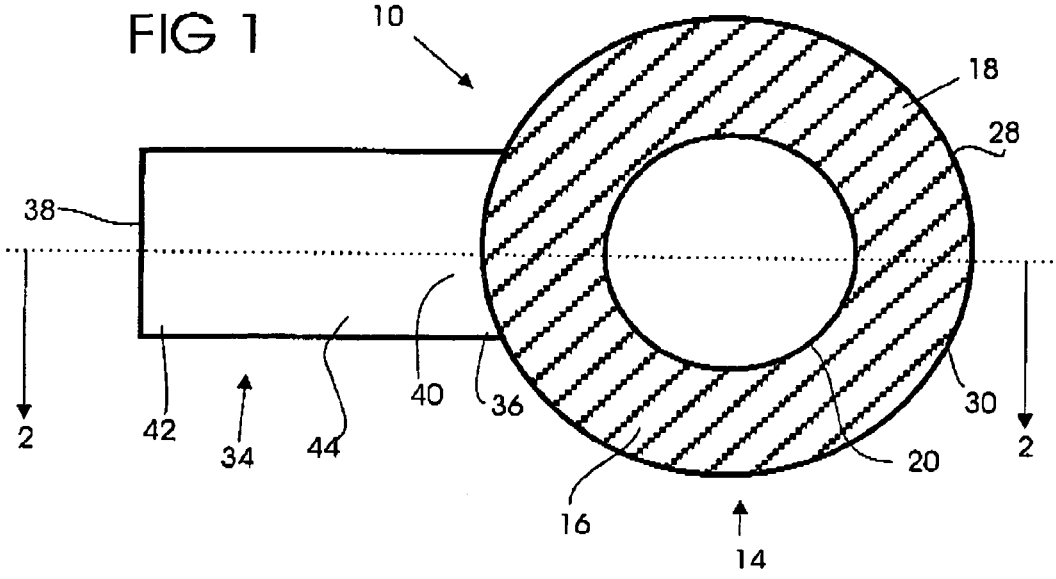
FIG. 1 is a top plan view of an exercise device illustrating one preferred embodiment thereof.
Figure 2:
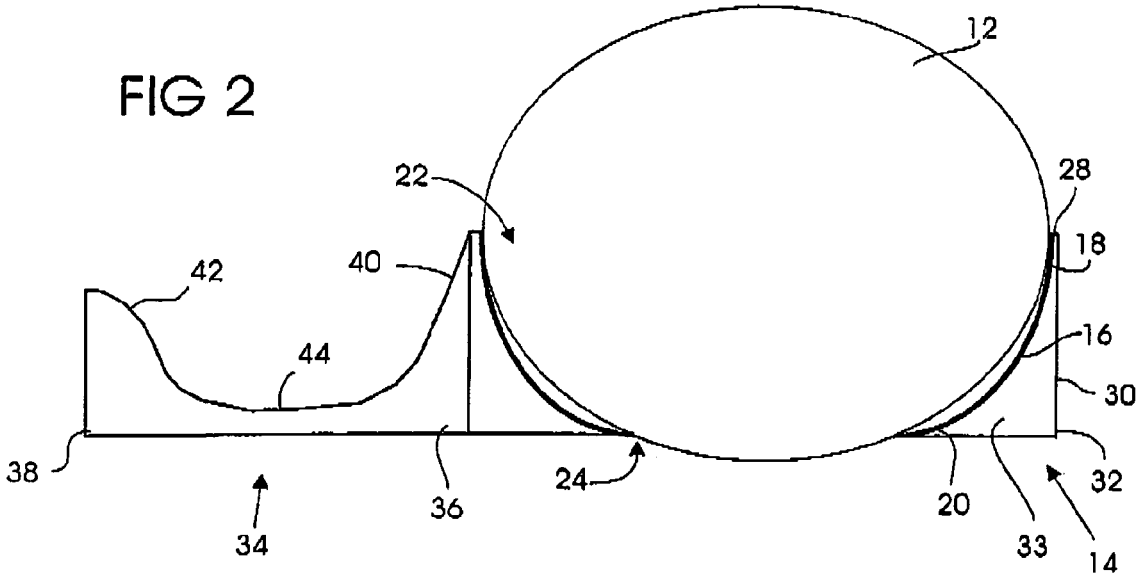
FIG. 2 is a cross-sectional view of the exercise device having an exercise ball therein taken long the line 2—2 of FIG. 1.
Figure 3:
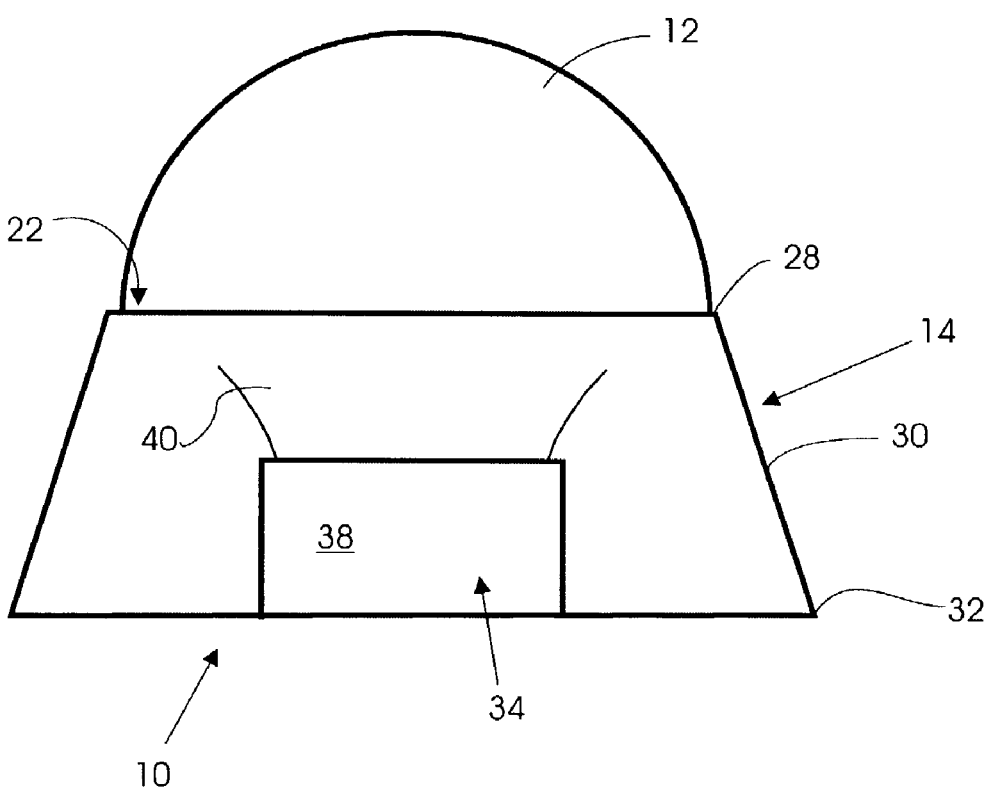
FIG. 3 is an elevational view of the exercise device taken from the back end thereof.

Referring to FIGS. 1, 2 and 3, therein is illustrated a device 10 for use in performing exercises or physical therapy in conjunction with an exercise ball 12. The ball 12 is typically a spherical bladder, preferably made of rubber or plastic, filled with air and configured to support the weight of the user. Accordingly, ball 12 is adapted to deform to accommodate a user thereon and is of sufficient resiliency and strength to return to its original spherical shape. The ball is used during exercise by bending the back or stomach over the ball as it is maintained in device 10. As such, the ball evenly distributes the weight of the user over the curvature of his spine or stomach thereby working all muscles more effectively and safely during exercise. Ball 12 can be obtained from Sissel, Inc., located in Sumas, Wash. In one preferred embodiment, ball 12 has a height of 30 inches. However it is to be understood that ball 12 may be of different heights and obtained from numerous manufacturers. Furthermore, device 10, in one preferred embodiment, may be created of a hard ABS plastic and may be injection molded in a unitary piece. However, alternate rigid and light weight materials may be substituted therefor and the device 10 may be constructed of numerous pieces that may be assembled using techniques that are known in the art.

Device 10 has a first region 14 that is adapted to receive and maintain ball 12 therein in a secure yet removable manner. First region 14 has an inner surface 16 that is of a concave nature that extends circumferentially to form a semi-spherical region that receives ball 12 therein. Inner surface 16 has a top region 18 and a bottom region 20. An opening 22 is defined by top region 18 and an aperture 24 is defined by bottom region 20 wherein aperture 24 is smaller than opening 22. Ball 12 is received within opening 22 such that ball 12 is maintained on inner surface 16 and an apex 26 of ball 12 passes through aperture 24 and rests directly on a support surface (not shown), such as a floor.

In one preferred embodiment, wherein a ball 12 has a height of 30 inches, opening 22 has a diameter of 31 inches to easily accommodate ball 12 therein. Furthermore, the slightly larger diameter of opening 22 allows for deformity of ball 12 wherein pressure from the weight of a user is applied thereto. Accordingly, it is to be understood that if ball 12 is of a lesser height, the size of opening 22 shall be decreased in relation to the size of ball 12 to allow a substantially corresponding fit between inner surface 16 and ball 12.

A ridge 28 extends outwardly from top region 18 of inner surface 16 to form a substantially ring shaped member. An outer surface 30 extends downwardly from ridge 28 and is of substantially equivalent height as inner surface 16. Outer surface 30 has a bottom area 32 that rests upon a support surface, such as a floor. Although outer surface 30 is illustrated as being of cylindrical shape in one preferred embodiment, it is to be understood that bottom area 32 may have a greater diameter than the ridge 28 such that outer surface 30 is inwardly angled. To conserve material and make device 10 light weight, a cavity 33 may be created between inner surface 16, outer surface 30 and ridge 28. However, it is also to be understood that cavity 33 may be eliminated by making first region 14 of a solid piece.

In one preferred embodiment, wherein the height of the ball 12 is 30 inches and the device is made of plastic, inner surface 16, ridge 28, and outer surface 30 have a thickness of one inch. As a result, the diameter of outer surface 30 will be approximately 33 inches at the ridge 28, and the diameter of outer surface 30 at bottom area 32 will be approximately 36 inches. The height of the inner surface 16 and outer surface 30 will vary depending on the height of ball 12. In the one preferred embodiment, where the height of the ball 12 is 30 inches, the height of the inner surface 16 and outer surface 30 is approximately 13 inches. However, in alternate preferred embodiments, it is to be understood that the height of the inner surface 16 and outer surface 30 may range from 20 percent to 60 percent of the height of the ball 12.

A second region 34 extends from outer surface 30 of first region 14. Second region 34 may be attached to first region 14 to form a unitary piece or second region 34 may be removably attached to first region 14 in a secure manner. Second region 34 has a front end 36 and a back end 38. A first area 40 is located proximal to front end 36 and a second area 42 is located proximal to back end 38 and a middle are 44 is defined between said first area 40 and second area 42. First area 40 and second area 42 are inclined in opposing directions such that a valley is created therebetween in middle area 44. In one preferred embodiment, where the height of ball 12 is 30 inches, the length of second region 34, as measured from front end 36 to back end 38, is preferably approximately 14 inches. However, it is to be understood that different lengths are possible for second region 34 and, in fact, the length may be adjustable by having a variety of second regions 34 that are removably attachable to first region 14.

Numerous exercise and physical therapy positions may be assumed by a user and for purposes of illustration, but not limitation, a few exercise options will be described herein. First area 40 is adapted to accommodate a lower back of a user such that a user is seated on middle area 44 and the user's upper back or shoulders may rest on ball 12. As such, the user may use free weights or elastic resistance members to engage in inclined bench style presses or inclined fly exercises. In another preferred method of use, while positioned as explained in detail immediately above, a user's elbows are positioned on opposing sides of ball 12 and the user may perform arm curls that target the biceps because of the restricted movement of the elbows. In another preferred method of use, a user may rest one's chest on ball 12 and engage in exercises that target the rear deltoids.

Figure 4:
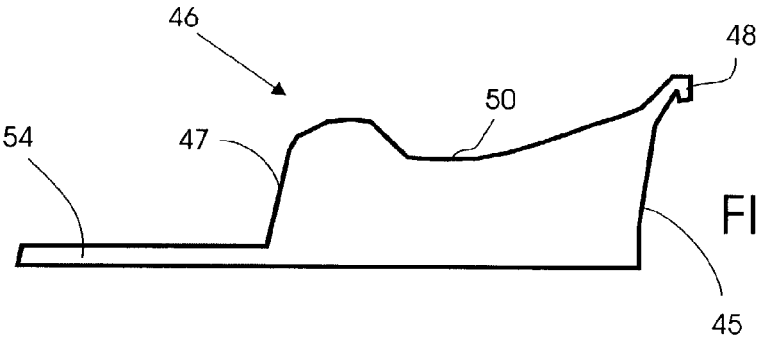
FIG. 4 is a side elevational view of an alternate preferred attachment to the exercise device.
Figure 5:
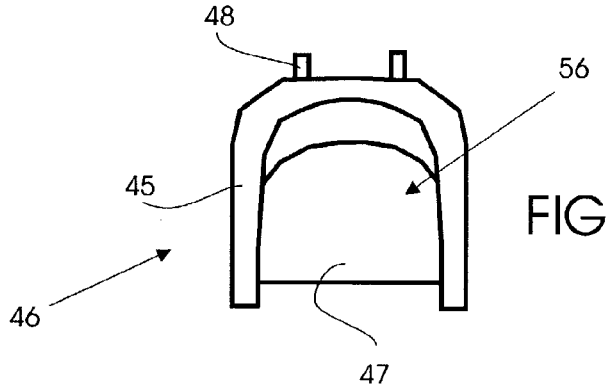
FIG. 5 is an elevational view of the alternate preferred attachment to the exercise device taken from a front end thereof.
Figure 6:
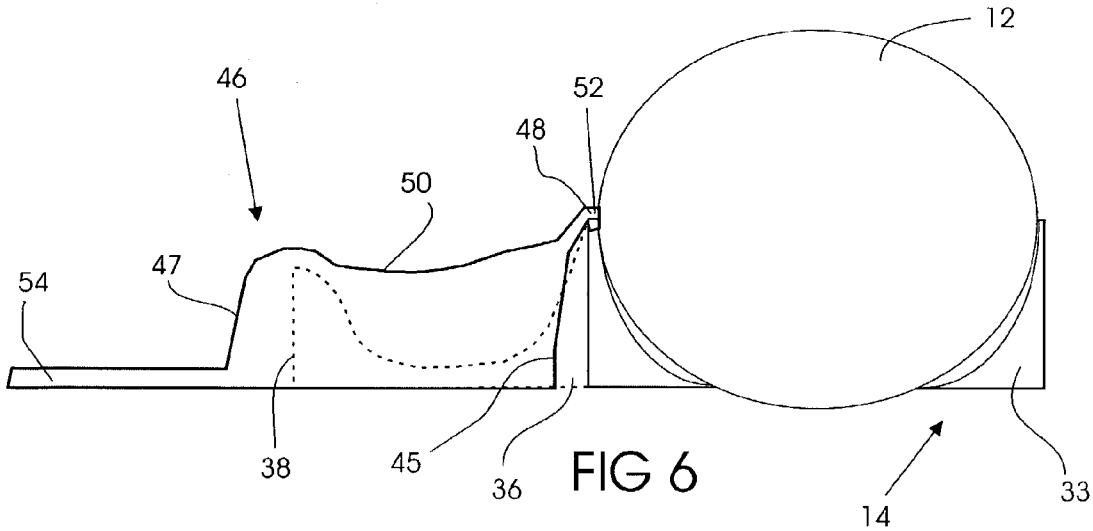
FIG. 6 is a cross sectional view of the exercise device and the attachment having the exercise ball mounted therein.

Now referring to FIGS. 4, 5 and 6, a member 46 is therein illustrated that may be removably, yet securely, attached to first region 14 in order to vary the angle of the body of a user resting thereon to effectively target the muscles during weight resistant exercise. Member 46 has a front section 45 and a back section 47 which are interconnected by a middle section 50.

Member 46 has at least a first attaching element 48 that extends from front section 45 and securely, yet removably, attaches member 46 to first region 14. Element 48 is substantially hook shaped such that it may be inserted into a first void 52 in first region 14 to engage the same. In an alternate preferred embodiment, there may be a plurality of attaching elements 48 and corresponding voids 52 to secure member 46 to first region 14. Extending from back section 47 is a lower section 54 that is adapted to accommodate the feet of a user and is appropriately textured to prevent the feet of a user from slipping.

Member 46 may be adapted to have an internal hollow 56 such that member 46 may be placed over and accommodate second region 34 within the hollow 56. In an alternate preferred embodiment, where second region 34 is removably attached to first region 14, hollow 56 may be eliminated and member 46 may be constructed of a solid piece of material and attached to first region 14 as taught above.

In using member 46, a user's posterior is positioned upon middle section 50 such that the shoulders of the user are received on ball 12 and the user may engage in weight resistance or isometric exercises as detailed above at a substantially level body position. Once again, the usage of the device 10 and member 46 is not limited to the above examples and may be adapted to perform a variety of exercises known in the art.

While the above description contains many specificities, these should not be construed as limitations on the scope of the invention, but rather as an exemplification of preferred embodiments thereof. Many other variations are possible without departing from the essential spirit of this invention. Accordingly, the scope of the invention should be determined not by the embodiments illustrated, but by the appended claims and their legal equivalents.

What is claimed is:

1. A device for use in physical activities, comprising:

a first region for securely yet removably maintaining an exercise ball therein;

an inner surface of said first region that is substantially concave and extends circumferentially to receive said ball;

an opening defined at a top region of the inner surface and an aperture defined at a bottom region of the inner surface;

a ridge extends outwardly from the top region of said inner surface and an outer surface extends downwardly and on an opposite side from said inner surface from said ridge wherein said ridge and said outer surface extend circumferentially to form an outer perimeter;

said inner surface and said outer surface have a height ranging from 20% to 60% of a height of said exercise ball, whereby stable support is provided for the exercise ball;

a second region for accommodating a portion of a user's body;

a bottom area distal to said ridge defined on said outer surface and said bottom area is more distal to a central axis passing through said opening and said aperture, whereby said bottom area has a greater diameter than said ridge;

a second region communicates with said outer surface, wherein said second region has a front end distal to a back end, said front end being attached to said outer surface and the second region further comprises a first area and a second area are interconnected by a middle area, wherein said first area is adapted to receive a back of the user, said second area is adapted to maintain the user's position in relation to the ball while seated on the middle area;

whereby, the user may engage in a plurality of exercise routines by positioning the user's body on the ball and second region.

2. The device of claim 1, wherein said opening has a larger diameter than said aperture and said aperture allows the ball to rest on a floor, whereby a portion of the user's weight may be distributed to the floor thereby maintaining the structural integrity of the inner surface.

3. The device of claim 1, wherein the height of said ball is approximately 30 inches and the height of said inner surface and said outer surface is approximately 13 inches.

4. The device of claim 1, wherein a member is removably attached to said first region by an attaching element, whereby the member receives a body part of the user and the ball receives another body part of the user during exercise.

5. An exercise device used in conjunction with an exercise ball, the device comprising:

a first region having an inner surface with a substantially concave shape that extends circumferentially to form a substantially semi-spherical shape;

an opening defined at a top region of the inner surface and an aperture defined at a bottom region of the inner surface, the opening having a larger diameter than said aperture;

a ridge extends outwardly from the top region of said inner surface and an outer surface extends downwardly from said ridge, said ridge and said outer surface extend circumferentially to form an outer perimeter, and said outer surface further comprises a bottom area distal to said ridge and said bottom area has a greater diameter than said ridge;

a second region for accommodating a user's body attached to said outer surface;

a front end distal to a back end defined on second region, said front end being attached to said outer surface, the second region further comprises a first area and a second area that are interconnected by a middle area, wherein said first area is adapted to receive a back of the user, said second area is adapted to maintain the user's position in relation to the ball, and the middle area is adapted to be sat on by the user;

whereby, the user may engage in a plurality of exercise routines by positioning the user's body on the ball and second region and the weight can be transferred to the floor surface through said aperture.

6. The device of claim 5, wherein a member is removably attached to said first region by an attaching element, whereby the member receives a body part of the user and the ball receives another body part of the user during exercise.

7. The device of claim 5, wherein said inner surface and said outer surface have a height of ranging from 20% to 60% of a height of said exercise ball.

8. The device of claim 5, wherein the height of said ball is approximately 30 inches, the height of said inner surface and said outer surface is approximately 13 inches, the diameter of said opening is approximately 31 inches, and the diameter of said aperture is approximately 16 inches.

9. A method of using an exercise device in conjunction with an inflatable exercise ball, comprising the steps of:

creating a concave inner surface that extends circumferentially to form a substantially semi-spherical structure having an opening defined by a top region of the inner surface and an aperture defined by the bottom region of the inner surface;

maintaining the ball within the opening and the inner surface in a secure yet removable manner such that the ball partially passes through said aperture and contacts a surface below;

attaching a second region having a first area and a second area that are interconnected by a middle area, whereby the middle area is at a lower height than the first and second areas;

resting a user's first body portion on the second area for stability;

resting the user's second body portion on the ball;

resting the user's posterior on the middle area and resting the user's back region on the ball;

performing weight resistant exercises while the user is position on the device.

* * * * *